US005979372A

United States Patent [19]

Park

[11] Patent Number: 5,979,372

[45] Date of Patent: Nov. 9, 1999

[54] METHOD OF SENSING MALFUNCTIONS OF A WATER SUPPLY SYSTEM FOR A BOILER AND APPARATUS THEREOF

[75] Inventor: Jae-Gyeong Park, Kwangjoo, Rep. of Korea

[73] Assignee: Daewoo Electronics Co., Ltd., Seoul, Rep. of Korea

[21] Appl. No.: 09/187,983

[22] Filed: Nov. 9, 1998

[51] Int. Cl.[6] ..... F22B 37/42

[52] U.S. Cl. ..... 122/504.2; 122/504

[58] Field of Search ..... 122/504, 504.1, 122/504.2, 507

[56] References Cited

U.S. PATENT DOCUMENTS 5,029,605 7/1991 Dowling et al. ..... 122/504

5,080,047 1/1992 Williams et al. ..... 122/35

5,355,840 10/1994 Violi ..... 122/447

*Primary Examiner*—Teresa Walberg

*Assistant Examiner*—Gregory A. Wilson

*Attorney, Agent, or Firm*—Jacobson, Price, Holman & Stern, PLLC

[57] ABSTRACT

A method, which senses malfunctions of a water supply system employed in a boiler system, comprises the steps of a) sensing a water level in a water tank; b) controlling a supplying of supplementary water from a water source to the water tank in response to the water level sensed by step a); c) sensing an amount of overflow water which has overflowed from the water tank; and d) determining whether the water supply system is out of order based on the water level sensed by step a), the amount of the overflow water sensed by step c), and a control state by step b).

10 Claims, 8 Drawing Sheets

METHOD OF SENSING MALFUNCTIONS OF A WATER SUPPLY SYSTEM FOR A BOILER AND APPARATUS THEREOF

BACKGROUND OF THE INVENTION

1. Field of the Invention

This invention relates to a method of sensing malfunctions of a water supply system employed in a boiler system and an apparatus thereof.

2. Description of the Prior Art

Generally, in a boiler system, heating water is heated in a heat exchanger of a boiler heated by heat generated by combustion of fuel such as a gas, petroleum or the like. The heating water heated in the heat exchanger is discharged to a heating pipeline system through a discharge pipe by the operation of a circulation pump of the boiler. Consequently, the indoor temperature of a heating place such as a house, a building or the like equipped with the heating pipeline system is elevated. The heating water in the heat exchanger is supplied from a water tank, and the heating water discharged from the heating pipeline system after heating the heating place returns to the water tank through a heating water return pipe. That is, the boiler system forms a heating water circulation circuit by the circulation of the heating water through the water tank, the heat exchanger, and the heating pipeline system.

The water tank supplements the heating water to the pipeline circuit when the heating water in the heating water circulation circuit of the boiler system is insufficient by the natural evaporation of the heating water therein. Furthermore, the water tank exhausts an increased or reduced pressure of the heating water in the pipeline circuit to an exterior therethrough, which is developed as the heating water volume in the pipeline circuit is varied by the temperature variation of the heating water.

Therefore, it is important in a boiler system to maintain an appropriate water level in the water tank.

FIG. 1 is a schematic diagram for showing a water supply system of the prior art.

As shown in FIG. 1, the water supply system 100 is provided with a water tank 110. The water tank 110 is provided with an overflow pipe 160 at an inner side therein. The overflow pipe 160 drains out the superfluous water in the water tank 110. A heating water discharging pipe 170 is connected with the water tank 110 for discharging heating water in the water tank 110 into a heat exchanger (not shown) therethrough. The water tank 110 is provided with a heating water return pipe(not shown) for returning the heating water from a heating pipeline system(not shown) to the water tank 110. The water tank 110 is connected with a water source(not shown) via a supplementary water pipe 120. A supplementary water valve 130 is installed at the supplementary water pipe 120 to be able to control a supplying of supplementary water from the water source to the water tank 110. The supplementary water valve 130 is electrically connected with a controller 140, and controlled by the controller 140. The controller 140 is electrically connected with a water level sensor 150. The water level sensor 150 is installed in the water tank 110, and senses a water level of the heating water in the water tank 110. The water level sensor 150 includes a float 151, a rod 152, and a magnetic switch 153. The float 151 moves up and down in accordance with changes of the water level in the water tank 110. One end of the rod 152 is connected with the float 151, and a magnet (not shown) is installed at the other end of the rod 152. The magnetic switch 153 is mounted on an upper inside wall of the water tank 110, and is turned on or off in response to a magnetic force generated from the magnet. That is, when the magnet approaches within a predetermined distance from the magnetic switch 153, the magnetic switch is turned on by the magnetic force of the magnet, and a turn-on signal generated by the magnetic switch 153 is outputted to the controller 140.

When a turn-off signal is inputted from the water level sensor 150 to the controller 140, the controller 140 controls the supplementary water valve 130 to be opened, such that supplementary water is supplied to the water tank 110 through the supplementary water valve 130. To the contrary, when the turn-off signal is inputted to the controller 140, the controller 140 causes the supplementary water valve 130 to close to cut off the supply of the supplementary water to the water tank 110. Therefore, the water level in the water tank 110 is kept at a constant level.

However, in the water supply system, when the water level sensor 150 or the supplementary water valve 130 is out of order, since the water supply system does not sense malfunctions of the water level sensor 150 and the supplementary water valve 130, the heating water in the water tank 110 is insufficient or the supplementary water is continuously supplied to the water tank 110.

For the foregoing reasons, there is a need for a method which can sense the malfunctions of a water supply system and an apparatus which can perform the method.

SUMMARY OF THE INVENTION

It is an object of the present invention to provide a method of sensing malfunctions of a water supply system for a boiler.

It is an another object of the present invention to provide an apparatus for sensing malfunctions of a water supply system for a boiler.

To accomplish the objects, according to one aspect of the present invention, there is provided a method of sensing malfunctions of a water supply system for a boiler. The method comprises the steps of a) sensing a water level in a water tank; b) controlling a supplying of a supplementary water from a water source to the water tank in response to the water level sensed by step a); c) sensing an amount of overflow water which has overflowed from the water tank; and d) determining whether the water supply system is out of order based on the water level sensed by step a), the amount of the overflow water sensed by step c), and a control state by step b).

According to another aspect of the present invention, there is provided an apparatus for sensing malfunctions of a water supply system for a boiler system. The apparatus comprises: a water tank; a supplementary water pipe connected to the water tank for supplying supplementary water from a water source to the water tank; a supplementary water valve disposed at the supplementary water pipe for controlling the supplying of the supplementary water through the supplementary water pipe to the water tank; a heating water discharge pipe for discharging heating water stored in the water tank into a heat exchanger of the boiler system; a heating water return pipe for returning the heating water from the heating exchanger to the water tank; an overflow pipe for draining out overflow water in the water tank to an exterior, the overflow water which is heating water overflowing a predetermined water level; an overflow sensor for sensing an amount of the overflow water which drains out through the overflow pipe; a water level sensor for sensing a level of the heating water stored in the water tank; and means for controlling the supplementary water valve in response to the level of the heating water sensed by the water level sensor and the amount of the overflow water sensed by the overflow sensor, wherein the controller determines whether the water level sensor or the supplementary water valve is out of order based on the level of the heating water, the amount of the overflow water, and a control state of the supplementary water valve in order to determine whether the water supply system is out of order.

According to the present invention, there is provided a method which can sense the malfunctions of a water supply system and an apparatus which can perform the method.

BRIEF DESCRIPTION OF THE DRAWINGS

This invention will be better understood and its various objects and advantages will be more fully appreciated from the following description taken in conjunction with the accompanying drawings, in which.

DETAILED DESCRIPTION OF THE PREFERRED EMBODIMENT

Preferred embodiments of the present invention will be illustrated below with reference to the accompanying drawings.

Figure 1:
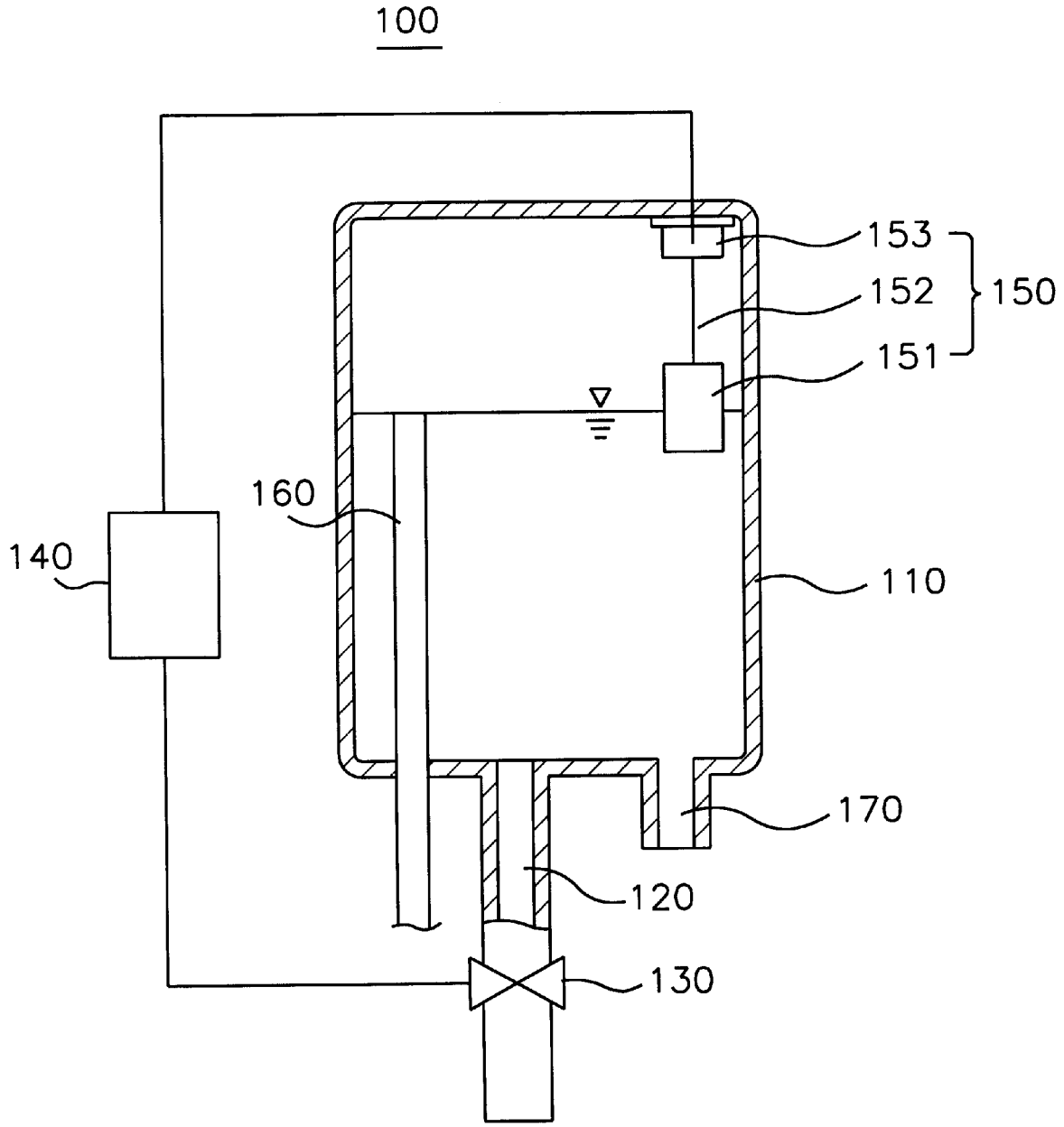
FIG. 1 (PRIOR ART)
FIG. 1 is a schematic view for showing a conventional water supply system for a boiler system.
Figure 2:
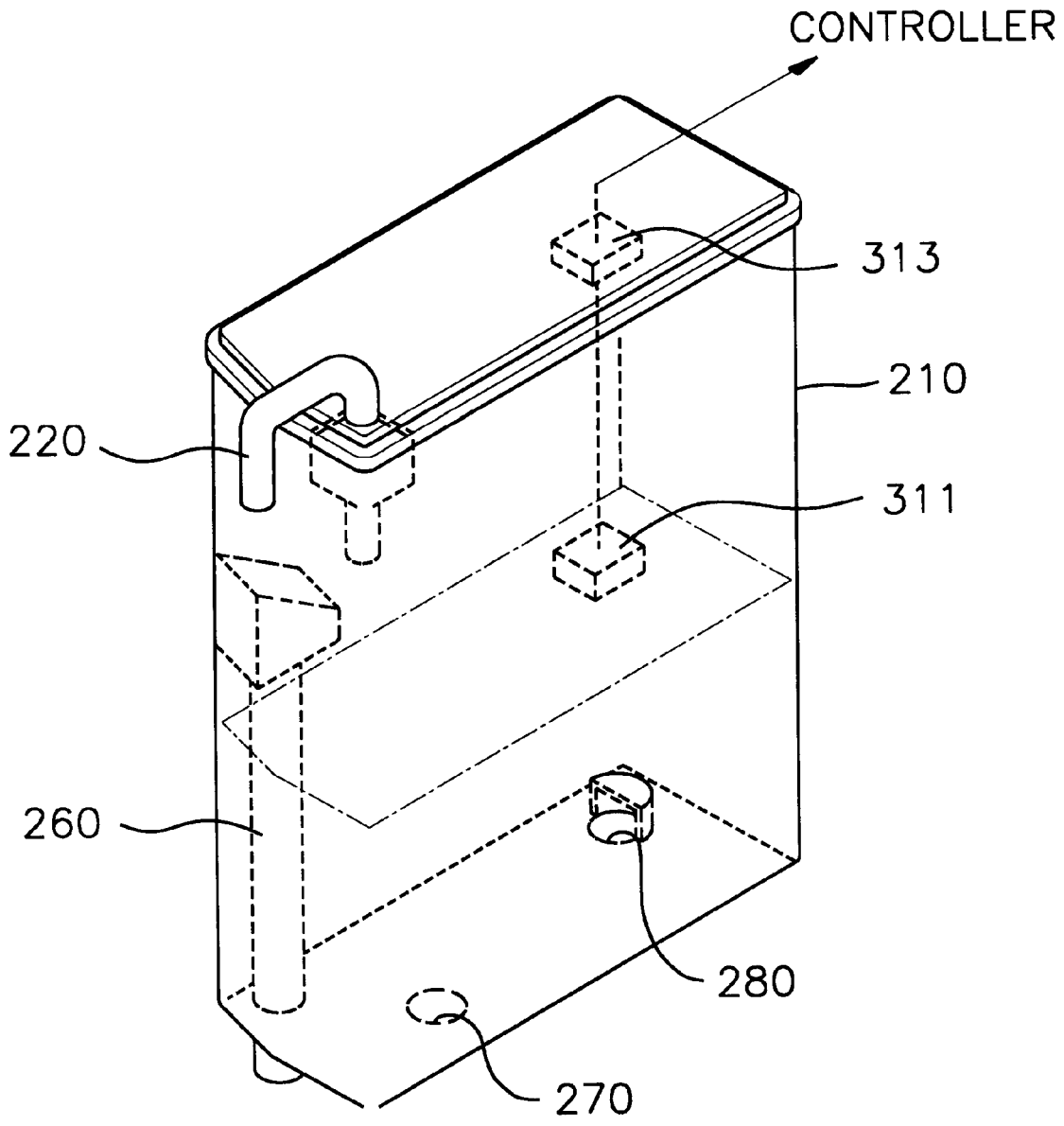
FIG. 2 is a perspective view for showing one example of a water tank which is employed in the present invention.
Figure 3:
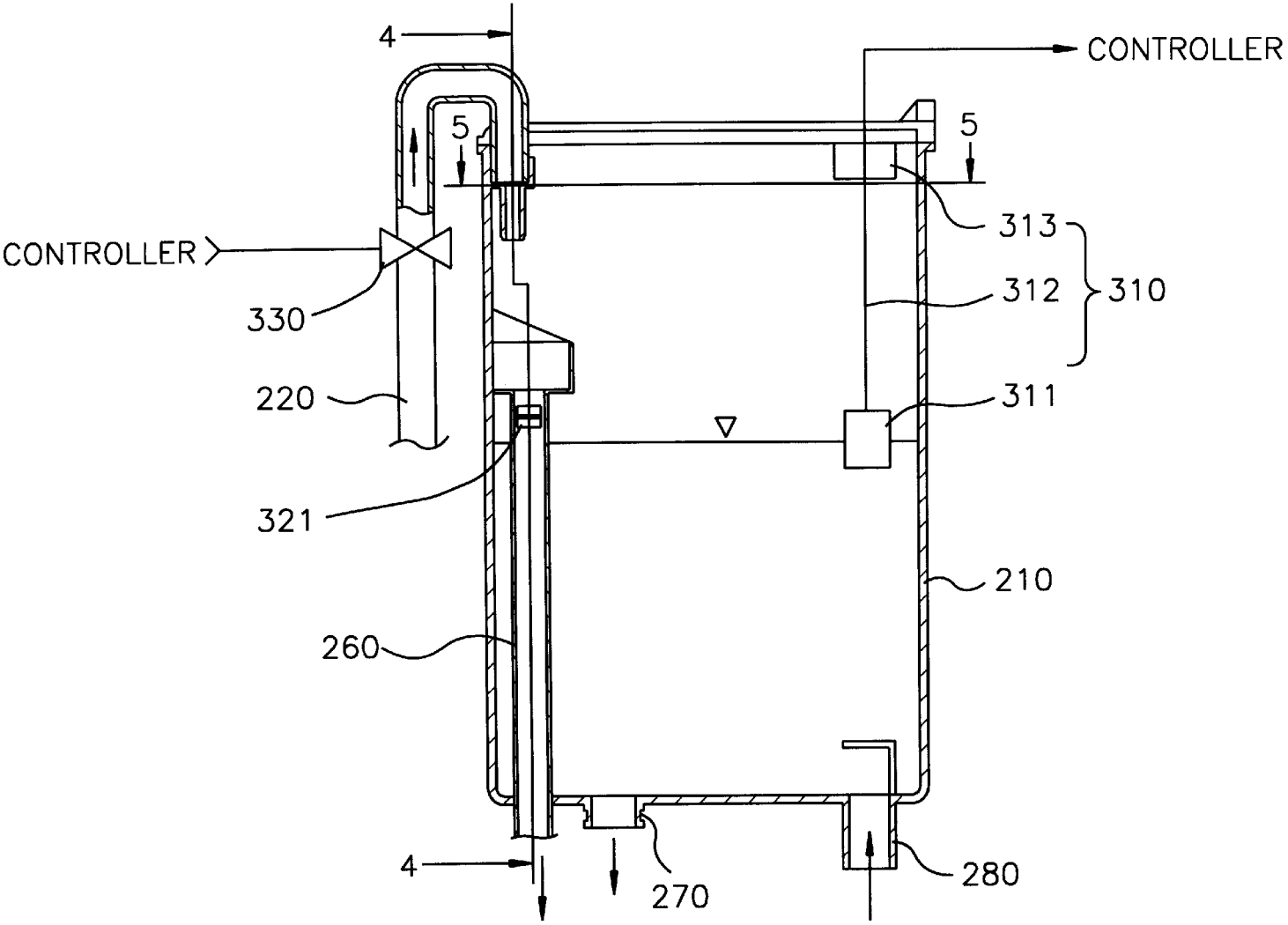
FIG. 3 is an elevational view for showing the water tank depicted in FIG. 2.
Figure 4:
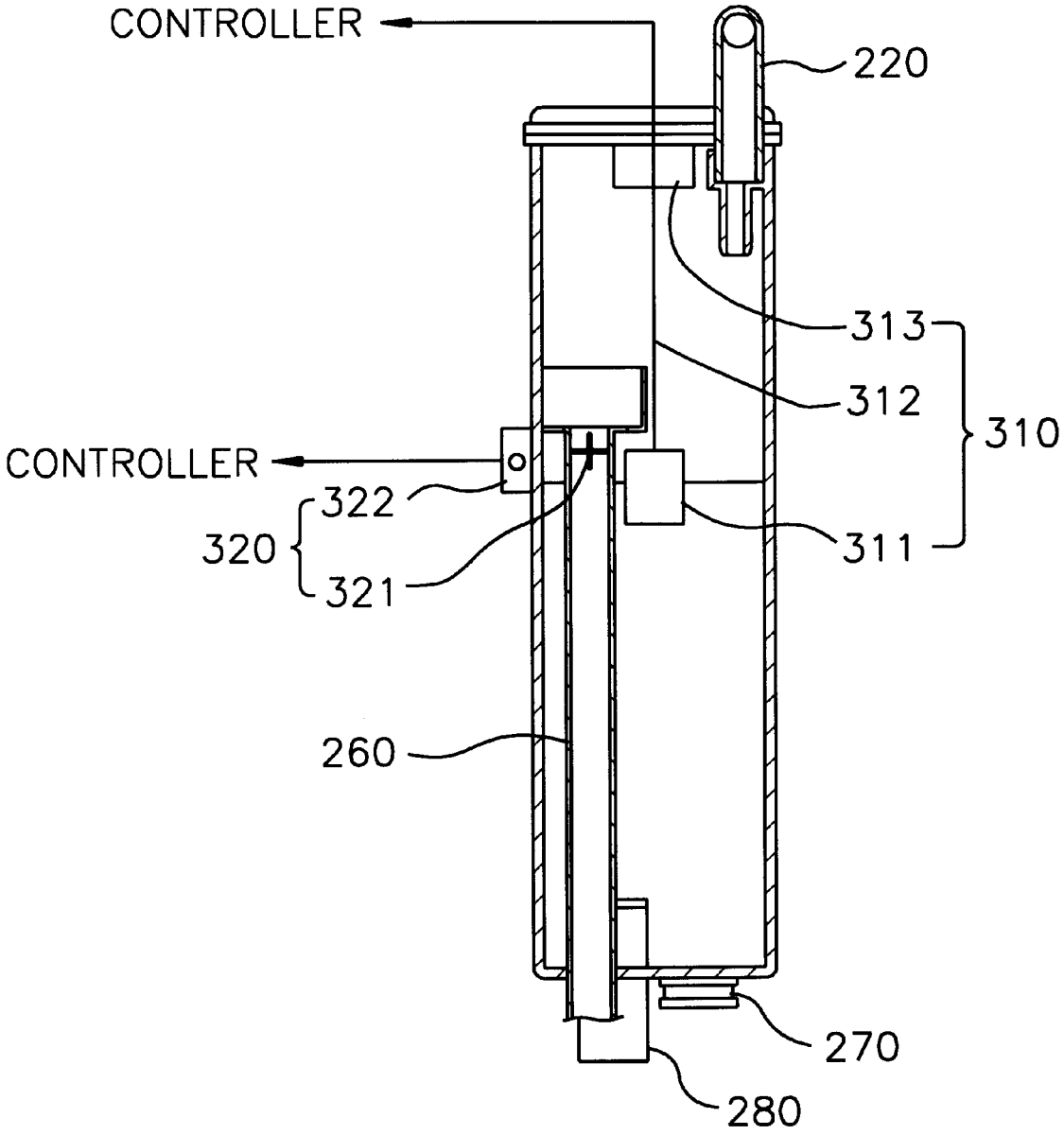
FIG. 4 is a sectional view taken along line 4—4 of FIG. 3.
Figure 5:
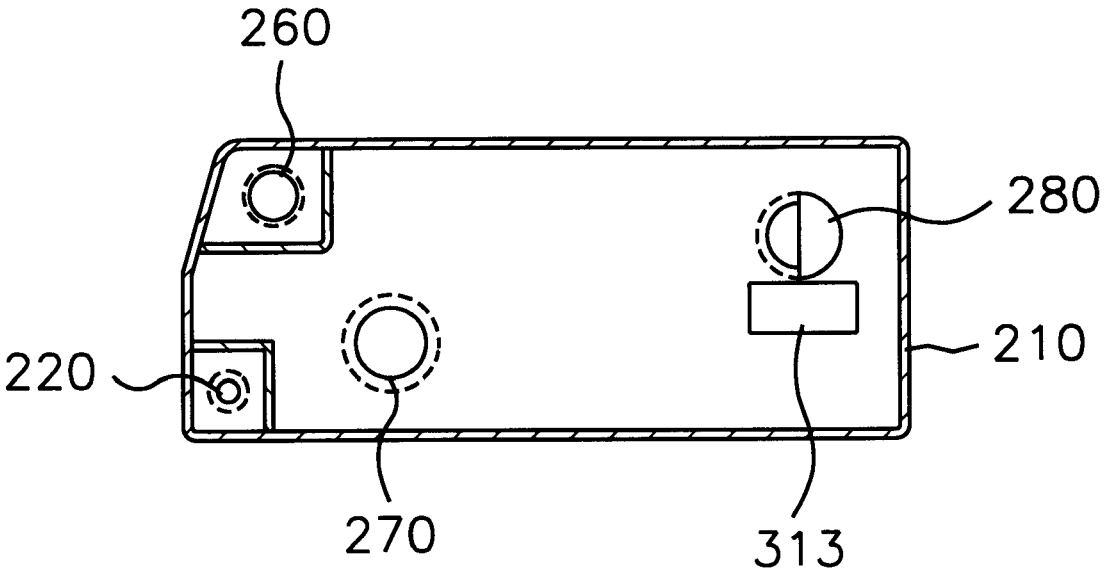
FIG. 5 is a sectional view taken along line 5—5 of FIG. 3.
Figure 6:
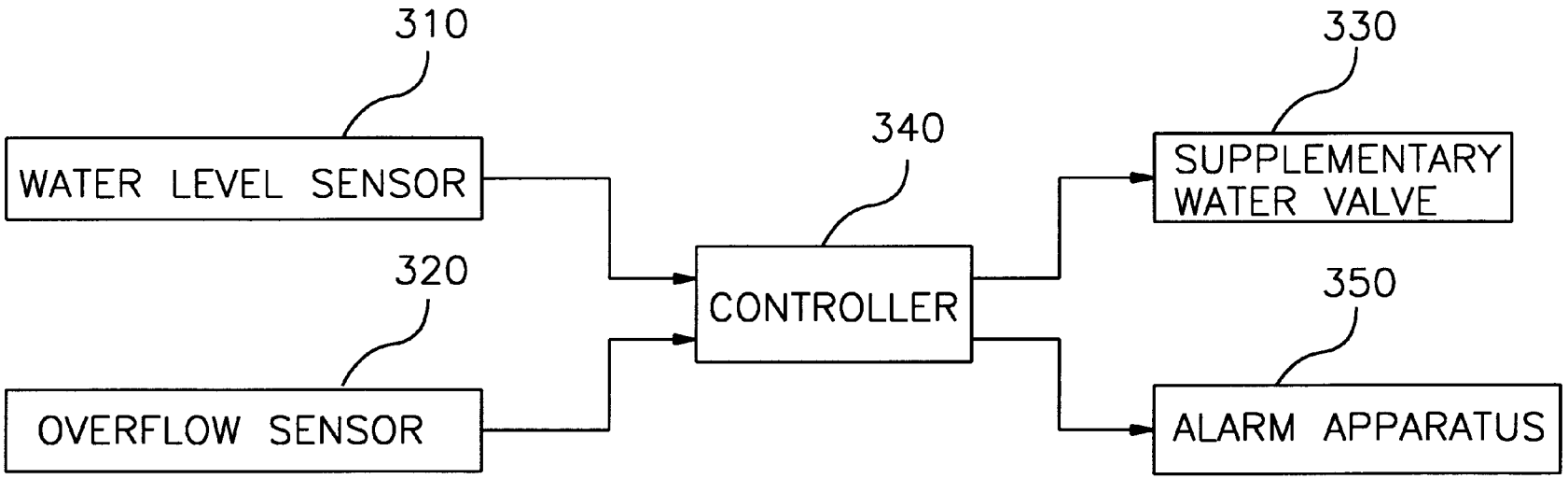
FIG. 6 is a block diagram for showing an apparatus according to one embodiment of the present invention.

FIG. 2 is a perspective view for showing one example of a water tank which is employed in the present invention. FIG. 3 is an elevational view for showing the water tank depicted in FIG. 2. FIG. 4 is a sectional view taken along line 4—4 of FIG. 3. FIG. 5 is a sectional view taken along line 5—5 of FIG. 3. And, FIG. 6 is a block diagram for showing an apparatus according to one embodiment of the present invention.

Referring to FIGS. 2 through 6, an apparatus for sensing malfunctions of a water supply system for a boiler system according to one embodiment of the present invention includes a water level sensor 310, an overflow sensor 320, a supplementary water valve 330, a controller 340, and an alarm apparatus 350.

The water level sensor 310 senses a water level in a water tank 210 in which heating water is stored, and generates a water level sensing signal corresponding to the sensing result. Preferably, the water level sensor 310 senses whether the water level of the water tank 210 falls to a predetermined level or less or not. For example, as shown in FIGS. 3 and 4, the water level sensor 310 includes a float 311, a rod 312, and a magnetic switch 313. The float 310 moves up or down in accordance to the change of the water level in the water tank 210. One end of the rod 312 is connected with the float 311, and a magnet(not shown) is installed at the other end of the rod 312. The magnetic switch 313 is mounted on an upper inside wall of the water tank 210, preferably a cover 370 of the water tank 210. The magnetic switch 313 is turned either on or off in response to a magnetic force generated from the magnet. That is, when the magnet approaches within a predetermined distance from the magnetic switch 313, the magnetic force having influence on the magnetic switch 313 becomes intense enough to allow the magnetic switch 313 to be turned on. To the contrary, when the heating water in the water tank 210 has dropped less than the predetermined level, the magnetic switch 313 is turned off by the decrease of the magnetic force. And, either a turn-on signal or a turn-off signal as the water level sensing signal generated by the magnetic switch 313 is outputted to the controller 340.

Figure 8:
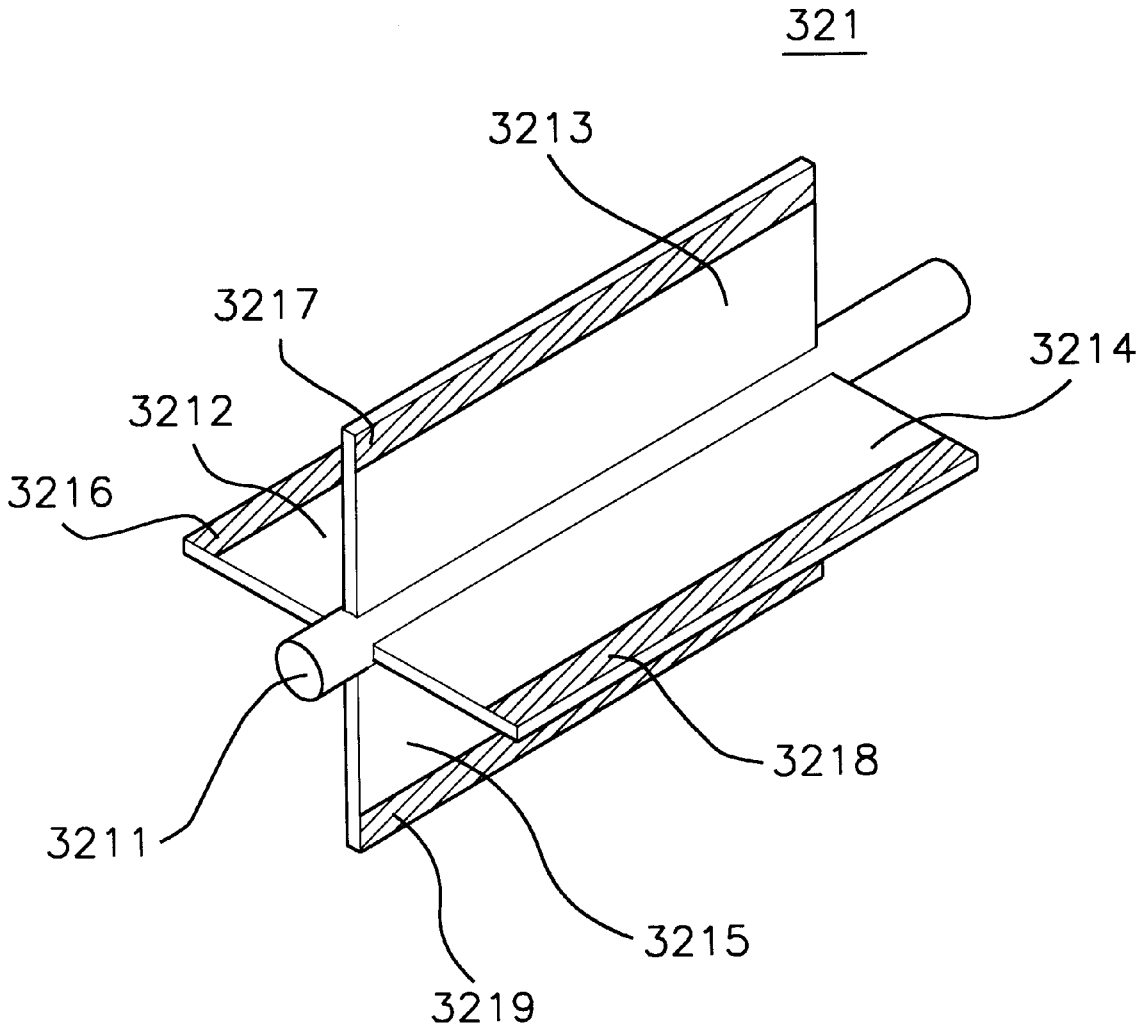
FIG. 8 is a prospective view for showing a rotary assembly depicted in FIGS. 3 and 4.

The overflow sensor 320 senses an amount of overflow water which drains out through an overflow pipe 260 extended from the water tank 210 to an exterior. For example, the overflow sensor 320 includes a rotary assembly 321 and a magnetic switch 322, as shown in FIG. 4. The rotary assembly 321 is installed in the overflow pipe 260. The rotary assembly 321 is rotated in proportion to a flowing velocity of overflow water draining out through the overflow pipe 260. Therefore, all the number of rotations of the rotary assembly 321 corresponds to the amount of overflow water. As shown in FIG. 8, the rotary assembly 321 includes a shaft 3211 and a plurality of blades, preferably four blades 3212 through 3215. The plurality of blades 3212 through 3215 are fixed to the shaft 3211 at regular angular intervals. Each of four blades 3212 through 3215 is provided with permanent magnets 3216 through 3219 along their edge portions, as shown in FIG. 8. Both end portions of the shaft 3211 are respectively inserted into first and second one-way bearings (not shown) which are disposed facing each other at a distal end of an inner wall of the overflow pipe 260. The shaft 3211 of the rotary assembly 321 is supported by the first and second one-way bearings in such a manner that it rotates only in one direction. The magnetic switch 322 is disposed close to the rotary assembly 321 at an outer surface of the water tank 210, such that the magnetic switch 32.2 is turned on or off in response to magnetic flux generated from the permanent magnets of the four blades 3212 through 3215. A switching number of the magnetic switch 322 is proportional to the amount of the overflow water passing through the overflow pipe 260. And, the overflow sensor 320 outputs the turn on and off signal to the controller 340 as an overflow sensing signal thereof.

As shown in FIGS. 2 through 5, a heating water discharge pipe 270 is connected to the water tank 210 for discharging the heating water to a heat exchanger (not shown). A heating water return pipe 280 is also connected to the water tank 210 for returning the heating water from a heating pipeline system (not shown) to the water tank 210.

The supplementary water valve 330 is installed at a supplementary water supply pipe 220 through which supplementary water is supplied from a water source (not shown) to the water tank 210, as shown in FIG. 3. The supplementary water valve 330 is electrically connected with and controlled by the controller 340. The supplementary water valve 330 controls the supplying of the supplementary water into the water tank 210 in accordance to controlling of the controller 340.

The controller 340 controls the supplementary water valve 330, as mentioned above. The controller 340 responds to the overflow sensing signal and the water level sensing signal. The controller 340 determines whether the water level sensor 310 or the supplementary water valve 330 is out of order in accordance to the overflow sensing signal and the water level sensing signal, such that the controller 340 determines whether the water supply system is out of order. When the water level sensor 310 or the supplementary water valve 330 is out of order, the controller 340 operates the alarm apparatus 350 to announce those malfunctions to a user.

When the amount of overflow water sensed by the overflow sensor 320 is more than a predetermined amount in such a state that the supplementary water valve 330 is turned off, the controller 340 determines that the supplementary water valve 330 is out of order. When the amount of overflow water sensed by the overflow sensor 320 is more than a predetermined amount and the water level in the water tank 210 sensed by the water level sensor 310 is less than a predetermined level in such a state that the supplementary water valve 330 is turned on, the controller 340 determines that the water level sensor 310 is out of order.

Hereinafter, operations of the apparatus will be described with reference to FIG. 7.

Figure 7:
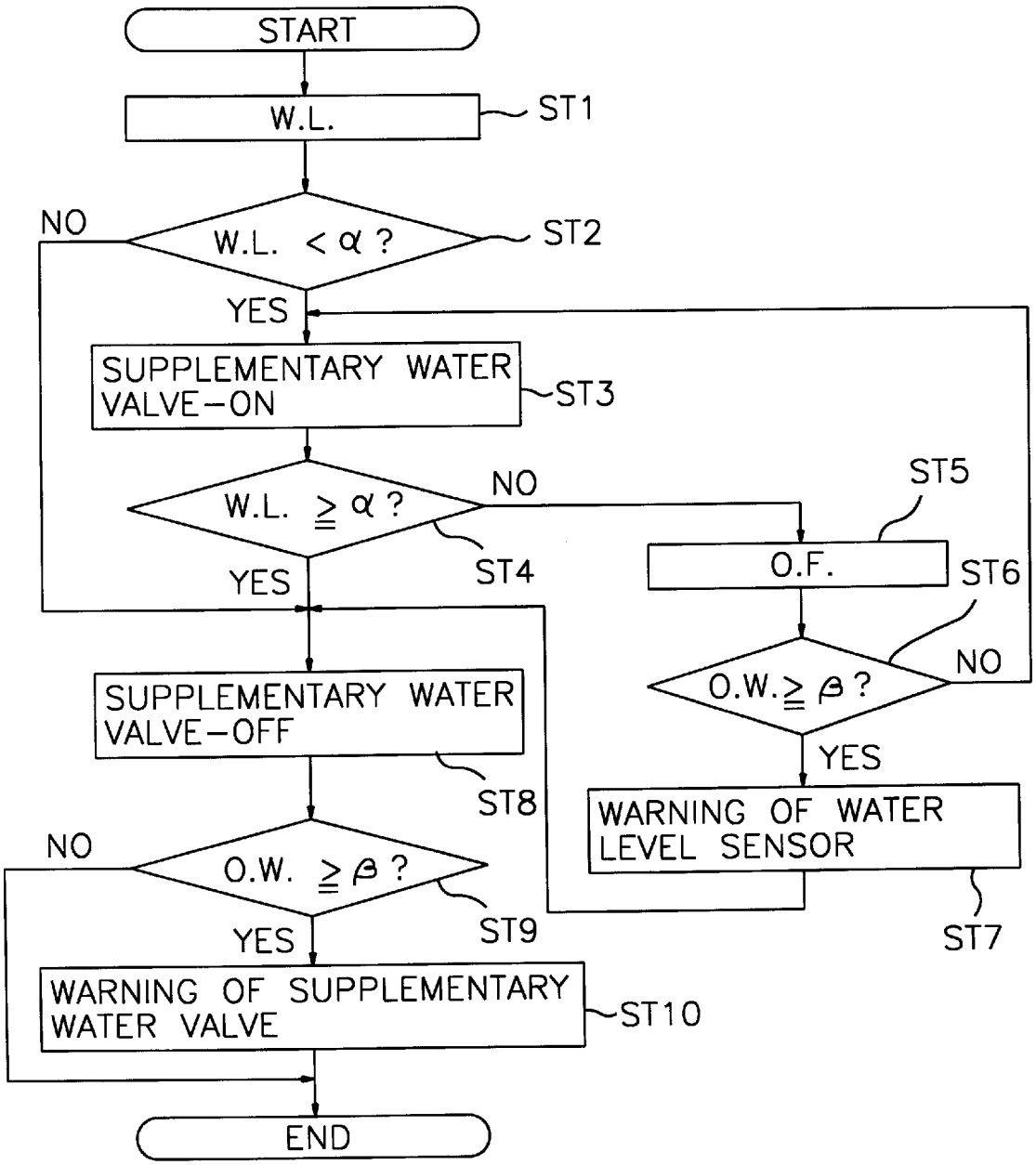
FIG. 7 is a flow chart for showing one exemplary operation of a controller depicted in FIG. 6.

FIG. 7 is a flow chart for showing one exemplary operation of a controller depicted in FIG. 6.

In a boiler system, the heating water in the water tank 210 is discharged through the heating water discharge pipe 270 to the heat exchanger. The heating water heated in the heat exchanger is circulated by a circulation pump (not shown), and again returned to the water tank 210 via a heating pipeline system(not shown) and the heating water return pipe 280. By this circulation of the heating water, a heating water circulation circuit is generally formed in the boiler system.

When in the heating water circulation circuit, the heating water is insufficient by natural evaporation or the volume variation of the heating water for the temperature, the heating water stored in the water tank 210 is supplemented into the heating water circulation circuit of the boiler system.

In a case where the heating water in the water tank 210 is supplemented into the heating water circulation circuit, that is, the amount of the heating water being returned through the heating water return pipe 280 to the water tank 210 is less than that of the heating water flowing out from the water tank 210, the level of heating water of the water tank 210 falls. When the water level of the water tank 210 falls to the predetermined level or less, the magnetic switch 313 of the water level sensor 310 is turned off, thereby generating a turn-off signal as the water sensing signal (ST1, ST2).

When the turn-off signal is inputted to the controller 340, the controller 340 controls the supplementary water valve 330 to be opened, such that supplementary water is supplied to the water tank 210 through the supplementary water pipe 260 (ST3).

As the heating water is supplemented through the supplementary water valve 330, the heating water in the water tank 210 rises more than the predetermined level. At this time, the magnetic switch 313 of the water level sensor 310 is turned on. And in response to the tune-on signal generated from the water level sensor 310, the controller 340 controls the supplementary water valve 330 to be closed to make the supply of the supplementary water stopped. That is, it is not until the heating water of the water tank 210 is filled to the predetermined level that the supplying of the supplementary water into the water tank 210 is finished (ST4).

While the supplementary water is supplied to the water tank 210, the controller 340 confirms whether the overflow sensor 320 senses an overflow of heating water. When the overflow sensor 320 senses the overflow of heating water, the controller 340 counts the number of on/off signals generated from the overflow sensor 320 while the heating water overflows from the water tank 210. The number of on/off signals is proportional to the total amount of overflow water overflowed through the overflow pipe 260 since the magnetic switch 322 of the overflow sensor 320 is switched on or off according to whether it senses the magnetic flux generated from each of the permanent magnets 3216 through 3219 of the rotary assembly 321 or not. That is, since four on/off signals are generated for one rotation of the rotary assembly 321, the total amount of overflow water is calculated by multiplying the rotational number of the rotary assembly 321 by the amount of which the heating water overflows for one rotation of the rotary assembly 321.

Therefore, the controller 340 compares the number of on/off signal with a predetermined reference value β corresponding to the predetermined reference amount in order to compare the amount of overflow water with the predetermined reference amount, so that the controller 340 can determine whether the amount of the overflow water is more than the predetermined reference amount or not (ST5, ST6).

When the number of on/off signals is greater than the predetermined reference value β, the controller 340 determines that the water level sensor 310 is out of order. And, the controller 340 controls the alarm apparatus to denote the malfunction of the water level sensor 310 (ST7).

As the supplementary water is supplied to the water tank 210, the water level of the heating water in the water tank 210 is increased. When the water level in the water tank 210 reaches to the predetermined reference level α, that is, the turn on signal is generated from the water level sensor 310, the controller 340 controls the supplementary water valve 330 to prohibit the supplementary water from being supplied to the water tank 210. And then, the controller 340 determines whether the on/off signals are generated from the overflow sensor 320 (ST9).

In case where the on/off signals are generated from the overflow sensor 320, the controller 340 determines whether the total number of on/off signals generated from the overflow sensor 320 is more than the predetermined reference value β. When the total number of on/off signals is more than the predetermined reference value β, the controller 340 determines that the supplementary water 330 is out of order. And, the controller 340 controls the alarm apparatus 350 to warn of the malfunction of the supplementary water valve 330 (ST10).

Therefore, according to the present invention, the apparatus senses the malfunctions of the water level sensor 310 or the supplementary water valve 340, thereby sensing malfunctions of a water supply system.

While this invention has been particularly shown and described with reference to particular embodiments thereof, it will be understood by those skilled in the art that various changes in form and details may be effected therein without departing from the spirit and scope of the invention as defined by the appended claims.

What is claimed is:

1. A method of sensing malfunctions of a water supply system for a boiler system, the method comprising the steps of:

a) sensing a water level in a water tank;

b) controlling a supplying of supplementary water from a water source to the water tank in response to the water level sensed by step a);

c) sensing an amount of overflow water which overflows from the water tank; and d) determining whether the water supply system is out of order based on the water level sensed by step a), the amount of overflow water sensed by step c), and a control state by step b).

2. A method as claimed in claim 1, wherein said step b) includes the steps of:

b-1) supplying the supplementary water into the water tank when the water level sensed by the step a) is lower than a predetermined level; and b-2) ceasing the supplying of the supplementary water into the water tank when the water level sensed by the step a) is equal to or higher than the predetermined level.

3. A methods claimed in claim 1, wherein the step d) includes the steps of:

d-1) comparing the amount of overflow water sensed by the step c) with a predetermined reference amount when by the step b), the supplementary water is supplied to the water tank; and d-2) determining whether the step a) is correctly performed based on the comparison result by the step d-1) in order to determine whether the water supply system is out of order.

4. A method as claimed in claim 3, further comprising the step d-3) of shutting off the supplying of the supplementary water to the water tank when it is determined by the step d-2) that the water level sensor is out of order.

5. A method as claimed in claim 1, wherein the step d) includes the steps of:

d-4) comparing the amount of the overflow water sensed by the step c) with a predetermined reference amount when by the step b), the supplementary water is not supplied to the water tank; and d-5) determining whether the step b) is correctly performed based on the comparison result by the step d-4) in order to determine whether the water supply system is out of order.

6. An apparatus for sensing malfunctions of a water supply system for a boiler system, the apparatus comprising:

a water tank;

a supplementary water pipe connected to the water tank for supplying a supplementary water from a water source to the water tank;

a supplementary water valve disposed at the supplementary water pipe for controlling the supplying of the supplementary water through the supplementary water pipe to the water tank;

a heating water discharge pipe for discharging heating water stored in the water tank into a heat exchanger of the boiler system;

a heating water return pipe for returning the heating water from the heating exchanger to the water tank;

an overflow pipe for draining out an overflow water in the water tank to an exterior, the overflow water which is heating water overflowing a predetermined reference water level;

an overflow sensor for sensing an amount of the overflow water which drains out through the overflow pipe;

a water level sensor for sensing a level of the heating water stored in the water tank; and means for controlling the supplementary water valve in response to the level of the heating water sensed by the water level sensor and the amount of the overflow water sensed by the overflow sensor, wherein the controller determines whether the water level sensor or the supplementary water valve is out of order based on the level of the heating water, the amount of the overflow water, and a control state of the supplementary water valve in order to determine whether the water supply system is out of order.

7. An apparatus as claimed in claim 6, further comprising means for warning of the malfunctions of the water supply system, and means for controlling the warning means according to the determination result.

8. An apparatus as claimed in claim 6, wherein said control means determines that the supplementary water valve is out of order when the amount of the overflow water is more than a predetermined amount and the supplementary water valve is turned off.

9. An apparatus as claimed in claim 6, wherein said control means determines that the water level sensor is out of order when the amount of the overflow water is more than a predetermined amount, the supplementary water valve is turned on, and the water level sensed by the water level sensor is less than a predetermined level.

10. An apparatus as claimed in claim 6, wherein said overflow sensor includes a rotor assembly disposed inside the overflow pipe to be rotated in proportion to the amount of the overflow water flowing through the overflow pipe; and a magnetic switch disposed closely to the rotor assembly at an outer surface of the water tank, the magnetic switch which is turned on or off in response to a magnetic flux generated from the rotor assembly to generate an on-off frequency, wherein the rotor assembly includes a shaft and a plurality of blades fixed to the shaft at regular angular intervals and each of the plurality of blades is provided with a permanent magnet at an edge portion thereof.

* * * * *